US005780152A

United States Patent [19]

Ichiryu et al.

[11] Patent Number: 5,780,152

[45] Date of Patent: Jul. 14, 1998

[54] HIGH TEMPERATURE RESISTANT BLENDED YARN

[75] Inventors: Takaharu Ichiryu, Otsu; Eiji Shinya, Kaizuka, both of Japan

[73] Assignees: Toyo Boseki Kabushiki Kaisha; Soshin Lining Co., Ltd., both of Osaka-fu, Japan

[21] Appl. No.: 802,554

[22] Filed: Feb. 19, 1997

[30] Foreign Application Priority Data

Feb. 19, 1996 [JP] Japan ..... 8-030966

[51] Int. Cl.[6] ..... D02G 3/00

[52] U.S. Cl. ..... 428/357; 428/394; 428/359

[58] Field of Search ..... 428/359, 394, 428/364, 357

[56] References Cited

U.S. PATENT DOCUMENTS

| | | | |
|---|---|---|---|
| 4,359,567 | 11/1982 | Evers | 528/179 |
| 4,533,692 | 8/1985 | Wolfe et al. | 524/417 |
| 4,533,693 | 8/1985 | Wolfe et al. | 524/417 |
| 4,533,724 | 8/1985 | Wolfe et al. | 528/313 |
| 4,578,432 | 3/1986 | Tsai et al. | 528/432 |
| 4,703,103 | 10/1987 | Wolfe et al. | 528/179 |
| 4,772,678 | 9/1988 | Sybert et al. | 528/179 |
| 4,847,350 | 7/1989 | Harris | 528/179 |
| 5,089,591 | 2/1992 | Gregory et al. | 528/185 |
| 5,233,821 | 8/1993 | Weber, Jr. et al. | 57/224 |
| 5,294,390 | 3/1994 | Rosenberg et al. | 264/103 |
| 5,527,609 | 6/1996 | Yabuki et al. | 428/359 |
| 5,624,752 | 4/1997 | Hokudoh | 428/359 |

FOREIGN PATENT DOCUMENTS

| | | |
|---|---|---|
| 0790339 | 8/1997 | European Pat. Off. . |
| B 56-11523 | 3/1981 | Japan . |
| 58-45145 | 3/1983 | Japan . |

*Primary Examiner*—Newton Edwards
*Attorney, Agent, or Firm*—Morrison & Foerster LLP

[57] ABSTRACT

High temperature resistant blended yarns exhibiting an ignition loss of 70% or less when heated in air at 850° C. for 30 minutes are provided. The blended yarns can attain, without using asbestos, heat resistance at 500° C. or higher temperatures, satisfactory resistance to flexing abrasion, high yields in the spinning step, excellent light-weight properties and soft touch.

12 Claims, No Drawings

HIGH TEMPERATURE RESISTANT BLENDED YARN

FIELD OF INVENTION

The present invention relates to heat resistant materials which can be used in place of asbestos. More particularly, the present invention relates to high temperature resistant blended yarns having excellent mechanical and physical properties, such as heat resistance, flexibility, strength, flexing resistance, abrasion resistance, cut resistance and light-weight properties.

BACKGROUND OF THE INVENTION

It has been well known that yarns made only of heat resistant fiber materials such as mineral fibers (e.g., asbestos), inorganic fibers (e.g., glass fibers, flameproof fibers obtained from acrylic fibers by flameproofing, carbon fibers, alumina fibers, silicon carbide fibers, inorganic whiskers, rock fibers, slag fibers) and metal fibers, or blended yarns made of these and other fiber materials, are used as heat resistant materials. These yarns have been used at relatively low temperatures, for example, 600° C. or lower, in the form of cloths or other fiber products, or by impregnating these cloths with heat resistant and flame retardant resins such as phenolic resins.

In recent years, the use of asbestos has been gradually restricted because of its adverse effects on the health of human bodies. Many studies have been made to find materials which can be used in place of asbestos.

As a material which can be used in place of asbestos, there have been widely used para-aramid fibers such as Kevlar®. The para-aramid fibers, however, have a drawback that they cause deterioration at high temperatures, for example, about 400° C.

As another material which can be used in place of asbestos, for example, the development of carbon fibers and ceramic fiber materials has been extensively carried out. In particular, ceramic fiber materials such as potassium titanate and alumina have excellent corrosion resistance and excellent heat resistance such that they can resist temperatures of 1200° C. or higher.

The carbon fibers and ceramic fiber materials, however, have poor resistance to flexing abrasion, so that they are liable to cause fracture. In particular, potassium titanate fiber materials exhibit very low yields in the blended yarn spinning step because of their relatively short lengths. Therefore, the spinning of only such fiber materials is quite difficult. Even if yarns are produced, good fiber products cannot be obtained.

In JP-A 58-46145/1983, heat shield cloths are disclosed which are produced by plain weave using base yarns obtained by reinforcement of blended yarns, which are made of ceramic fibers and flameproof fibers obtained by baking organic fibers such as acrylic fibers for their carbonization, with metal wires such as brass wires, copper wires, stainless steel wires, inconel wires and monel wires. These heat shield cloths are used as curtains for the purpose of preventing the scattering of welding sparks and molten metal; however, no disclosure is found on the workability, resistance to flexing abrasion of the blended yarn materials themselves, and elasticity. The above carbonized fibers usually have poor flexibility and are liable to cause fracture. Therefore, high-level techniques are required at the time of processing such as spinning and weaving steps, and the resulting cloths cannot be used for products which undergo repeated deformation, such as heat resistant packings and heat resistant conveyor belts.

In JP-B 7-26270/1995, doubled-and-twisted yarns are disclosed which are produced by blended yarn spinning of ceramic fibers and stainless steel fibers; however, the resulting blended yarn inevitably becomes heavy because both of the base fibers have high specific gravity.

As described above, there have not yet been developed fibers having excellent properties such as spinning workability and heat resistance, which can be used in place of asbestos.

SUMMARY OF THE INVENTION

The object of the present invention, which makes it possible to solve the above problems, is to provide a high temperature resistant blended yarn which can attain, without using asbestos, heat resistance at 500° C. or higher temperatures, satisfactory resistance to flexing abrasion, high yields in the spinning step, excellent light-weight properties and soft hand.

The high temperature resistant blended yarn of the present invention exhibits an ignition loss of 70% or less, preferably 60% or less, and more preferably 50% or less, when heated in air at 850° C. for 30 minutes.

The blended yarn in a preferred embodiment comprises a polybenzazole fiber in an amount of from 1% to 99% by weight.

The blended yarn in a preferred embodiment has a tensile strength of at least 0.1 kgf/g after heating in air at 400° C. for 30 minutes.

The blended yarn in a preferred embodiment exhibits at least 50% retention of strength on ignition.

The present invention further provides a high temperature resistant blended yarn comprising a heat resistant organic fiber and at least one selected from the group consisting of inorganic fibers and metal fibers, wherein the heat resistant organic fiber exhibits an ignition loss of 70% or less, preferably 60% or less, and more preferably 40% or less, when heated in air at 500° C. for 60 minutes, and of 85% or less, preferably 30% or less, when heated in air at 800° C. for 30 minutes.

The blended yarn in a preferred embodiment comprises a polybenzazole fiber as the heat resistant organic fiber in an amount of from 1% to 99% by weight.

DETAILED DESCRIPTION OF THE INVENTION

The high temperature resistant blended yarn of the present invention exhibits an ignition loss of 70% or less, preferably 60% or less, and more preferably 50% or less, when heated in air at 850° C. for 30 minutes. Lower values of ignition loss are preferred because the high temperature resistant blended yarn has improved heat resistance. The term "ignition loss" as used herein refers to the weight change (%) of a sample piece by heating at a prescribed temperature, which is represented by the expression:

$$\text{Ignition loss (\%)} = \frac{m_1 - m_2}{m_1} \times 100 \quad [1]$$

where $m_1$ is the dry weight (g) of a sample piece before heating and $m_2$ is the weight (g) of the sample piece after heating. The drying and weight measurement of the sample piece are carried out in accordance with JIS R 3450 as described for ignition loss of asbestos. If the resulting blended yarn exhibits an ignition loss of more than 70% when heated in air at 850° C. for 30 minutes, it has poor heat resistance and deteriorated retention of shape.

The high temperature resistant blended yarn of the present invention may preferably have a tensile strength of at least 0.1 kgf/g, more preferably from 4 to 30 kgf/g, after heating in air at 400° C. for 30 minutes. If the resulting blended yarn has a tensile strength of less than 0.1 kgf/g after heating in air at 400° C. for 30 minutes, it does not always have satisfactory resistance to flexing abrasion such that it can be used in place of asbestos. The tensile strength is measured in accordance with JIS R 3450.

The high temperature resistant blended yarn of the present invention may preferably exhibit at least 50%, more preferably at least 60%, retention of strength on ignition. The retention of strength on ignition is represented by the expression:

$$\text{Retention of strengh on ignition (\%)} = \frac{S_1}{S_0} \times 100 \quad [2]$$

where $S_0$ is the tensile strength (kgf/g) of a blended yarn before heating and $S_1$ is the tensile strength (kgf/g) of the blended yarn after heating. If the resulting blended yarn exhibits less than 50% retention of strength on ignition, it does not have satisfactory heat resistance such that it can be used in place of asbestos.

The high temperature resistant blended yarn of the present invention comprises a heat resistant organic fiber as described below.

The heat resistant organic fiber used in the present invention has to exhibit an ignition loss of 70% or less, preferably 60% or less, and more preferably 40% or less, when heated in air at 500° C. for 60 minutes. If the heat resistant organic fiber used exhibits an ignition loss of more than 70% when heated in air at 500° C. for 60 minutes, the resulting blended yarn has poor heat resistance. The heat resistant organic fiber used in the present invention further has to exhibit an ignition loss of 85% or less, preferably 30% or less, when heated in air at 800° C. for 30 minutes. The ignition loss of such a heat resistant organic fiber is measured in the same manner as described above for the ignition loss of a high temperature resistant blended yarn.

Examples of the heat resistant organic fiber which meet the above two requirements on the ignition loss include polybenzazole fibers. In the high temperature resistant blended yarn of the present invention, the polybenzazole fiber may preferably be contained in an amount of from 1% to 99% by weight, more preferably from 10% to 95% by weight, based on the total weight of the high temperature resistant blended yarn. With an increase in the amount of polybenzazole fibers contained, the resulting blended yarn not only have improved strength, abrasion resistance and flexibility but also have good properties when passing through a card in the stage of production, and the yield is increased.

The term "polybenzazole fiber" as used herein refers to various fibers made of polybenzazole (PBZ) polymers. Examples of the polybenzazole (PBZ) polymer include polybenzoxazole (PBO) and polybenzothiazole (PBT) homopolymers, as well as random, sequential or block copolymers of their monomer components.

The polybenzoxazole and polybenzothiazole, as well as random, sequential or block copolymers of their monomer components, are disclosed in, for example, Wolfe et al., "Liquid Crystalline Polymer Compositions, Production Process and Products", U.S. Pat. No. 4,703,103 (Oct. 27, 1987), "Liquid Crystalline Polymer Compositions, Production Process and Products", U.S. Pat. No. 4,533,692 (Aug. 6, 1985), "Liquid Crystalline Poly-(2,6-benzothiazole) Compositions, Production Process and Products", U.S. Pat. No. 4,533,724 (Aug. 6, 1985), "Liquid Crystalline Polymer Compositions, Production Process and Products", U.S. Pat. No. 4,533,693 (Aug. 6, 1985); Evers, "Thermooxidatively Stable Articulated p-Benzobisoxazole and p-Benzobisthiazole Polymers", U.S. Pat. No. 4,359,567 (Nov. 16, 1982); and Tsai et al., "Method for Making Heterocyclic Block Copolymer", U.S. Pat. No. 4,578,432 (Mar. 25, 1986).

The PBZ polymers are lyotropic liquid crystal polymers which are composed of homopolymers or copolymers containing, as the main base unit, at least one selected from the units depicted by the structural formulas (a) to (h):

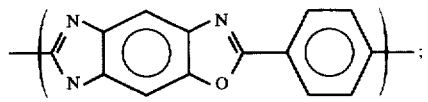
(a)

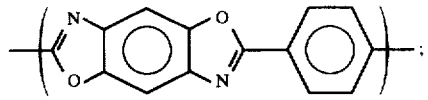
(b)

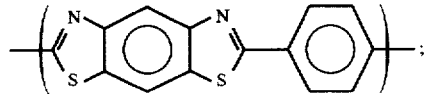
(c)

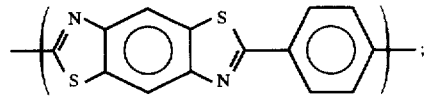
(d)

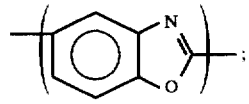
(e)

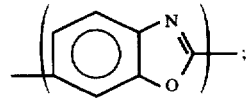
(f)

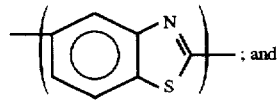
; and (g)

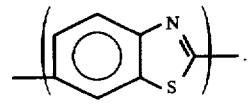
(h)

The PBZ polymers may preferably contain, as the main base unit, at least one selected from the units depicted by the above structural formulas (a) to (c).

The PBZ polymers and copolymers can be produced by any of the known methods, such as disclosed in Wolfe et al., U.S. Pat. No. 4,533,693 (Aug. 6, 1985); Sybert et al. U.S. Pat. No. 4,772,678 (Sep. 20, 1988); and Harris, U.S. Pat. No. 4,847,350 (Jul. 11, 1989). According to the disclosure of Gregory et al., U.S. Pat. No. 5,089,591 (Feb. 18, 1992), the degree of polymerization for PBZ polymers can be raised at high reaction rates under relatively high temperature and high shearing conditions under a non-oxidative atmosphere in a dehydrating acid solvent.

To produce polybenzazole fibers, a dope of a PBZ polymer is first prepared using, as the solvent, cresol or non-oxidative acids in which the PBZ polymer can be dissolved. Examples of the non-oxidative acid solvent include polyphosphoric acid, methanesulfonic acid and high concentration sulfuric acid, or mixtures thereof. Preferred solvents are polyphosphoric acid and methanesulfonic acid. The most preferred is polyphosphoric acid.

The dope may contain a PBZ polymer in an amount of at least 7% by weight. The polymer concentration in the dope may preferably be at least 10% by weight and most preferably at least 14% by weight, which is, however, usually adjusted to less than 20% by weight in view of good handling properties by increased polymer solubility and decreased dope viscosity. Such a dope is also well known in U.S. Pat. Nos. 4,533,693, 4,772,678 and 4,847,350.

From the dope thus obtained, polybenzazole fibers with high temperature resistance, high tensile strength and high tensile modulus can be produced by any of the known methods (e.g., the dry-and-wet spinning method as disclosed in U.S. Pat. No. 5,294,390 (May 15, 1994)). The resulting polybenzazole fibers are then subjected to the ordinary staple production step.

The ordinary crimping step may be carried out during the staple production step. The above polybenzazole fibers may preferably have crimps, particularly in view of improved spinning properties.

In this manner, polybenzazole fibers with any denier and any cut length can be obtained. The cut length may preferably be in the range of from 25 to 100 mm in view of properties for passing through a card.

The high temperature resistant blended yarn of the present invention may comprise at least one selected from the group consisting of inorganic fibers and metal fibers as described below.

Examples of the inorganic fiber used in the present invention include ceramic fibers, glass fibers, flameproof fibers obtained from acrylic fibers by flameproofing, carbon fibers, alumina fibers, silicone carbide fibers, inorganic whiskers, rock fibers (rock wool) and slag fibers. The use of ceramic fibers is particularly preferred in view of improved heat resistance. The ceramic fibers are strongly bound together by blended yarn spinning with the above heat resistant organic fibers, which prevents the scattering of the ceramic fibers themselves.

The above ceramic fibers are produced, for example, as follows: a starting material such as calcined kaolin or alumina-silica, to which an appropriate amount of flux is added, if necessary, is melted at about 2200° C. to about 2300° C. in an induction heating furnace, which is allowed to flow out; and then, the melt is blown off by compressed air or high pressure steam (blowing method), or the melt is dropped to the side surface of a rotating disk and hence formed into a fiber by centrifugal force (spinning method). Thus, ceramic bulk fibers in the assembled state without secondary processing are obtained. The ceramic bulk fibers have a fiber diameter of from 1 to 5 μm and a prescribed length, for example, 50 mm or shorter. The ceramic bulk fibers further have heat resistance at 1200° C. or higher temperatures.

The above inorganic fibers may preferably have a tensile strength of about 110 kgf/mm$^2$.

The metal fibers used in the present invention are not particularly limited, so long as they can pass through a card. Examples of the metal fiber include stainless steel fibers and aluminum fibers having a diameter of about 23 μm. The use of such stainless steel fibers is particularly preferred because of their excellent corrosion resistance and excellent heat resistance. Stainless steel fibers are somewhat inferior to ceramic fibers in corrosion or heat resistance, but are superior to ceramic fibers in resistance to flexing abrasion by bending or the like and also in flexibility. If the stainless steel fibers are spun as a blended yarn with the above heat resistant organic fibers, the resulting blended yarn can have remarkably improved heat resistance and strength.

The stainless steel fibers may preferably have a fiber diameter of from 2 to 50 μm, more preferably from 6 to 10 μm. If the stainless steel fibers have a fiber diameter of more than 50 μm, it is difficult to disperse them uniformly in the blended yarn and their entanglements with the heat resistant organic fibers is liable to become poor. On the other hand, if the fiber diameter is less than 2 μm, the stainless steel fibers themselves are liable to come under the influence of heat, and the resulting blended yarn may have poor heat resistance.

The stainless steel fibers can be used, for example, in the form of slivers which are obtained by cutting, for example, in a desired length of from about 20 to about 100 mm, a tow of stainless steel fiber bundles prepared by the multi-wire drawing method as described in JP-B 56-11523.

The above metal fibers may have a tensile strength of about 135 kgf/mm$^2$ and also have toughness, so that they are not broken as is the case with ceramic fibers.

In the case where the inorganic fibers and the metal fibers are both used in the high temperature resistant blended yarn of the present invention, the amounts of these fibers can be freely determined, based on the total weight of the blended yarn.

The blended yarn of the present invention is produced in the following manner using heat resistant organic fibers and inorganic fibers and/or metal fibers.

First, heat resistant organic fibers such as polybenzazole fibers are opened by an opening machine, with which inorganic fibers and/or metal fibers are blended at the same time. This blend is then spun out in the form of slivers by a special carding machine. These slivers are provided with twists of from about 2 to about 10 turns/inch, for example, by a ring spinning machine. The twists may be in the direction of either Z-twists or S-twists. In this manner, the entanglements of the above fibers is complicated, and a blended yarn with any count is obtained by circumferential pressure of twists.

Thus, the high temperature resistant blended yarn of the present invention is produced.

The high temperature resistant blended yarns of the present invention can be used alone or in doubled-and-twisted form as heat resistant yarns, heat resistant braids, heat resistant cords, heat resistant ropes or other products. The high temperature resistant blended yarns of the present invention can also be used by any of the known methods such as plain weave and combination weave, for example, as heat resistant cushioning materials, heat resistant conveyor belt materials, heat resistant packings, heat resistant gaskets, heat resistant expansion joints (flexible joints), various thermal insulating materials, covering or sealing materials for wires, tubes and pipes, brake lining materials, clutch lining materials, fire-protecting products such as fire curtains, or noise eliminating heat resistant cushioning materials for material carrier rolls used in iron foundries or other facilities. The above products can be made in composite form for reinforcement, if desired, with metal wires such as brass wires in the stage of production. The above products can also be impregnated with heat resistant and flame retardant resins such as phenolic resins in the stage of blended yarn or cloth production. To improve the cushioning properties, it is preferred that the blended yarn is woven into three to ten combined layers to have a thickness of 2 to 20 mm. Furthermore, the high temperature resistant blended yarn of the present invention can be applied to knitted products such as gloves, which therefore exhibit excellent cut resistance as well as excellent heat resistance.

EXAMPLES

The present invention is further illustrated by the following examples which are not to be construed to limit the scope thereof.

The blended yarns and doubled-and-twisted yarns obtained in these Examples were evaluated as follows:

Moisture Content

The moisture content was measured in accordance with JIS R 3450. Lower values of moisture content indicate that the resulting blended yarn or doubled-and-twisted yarn has a smaller water content.

Spinning Yield

The spinning yield was determined by the expression:

$$\text{Spinning yield (\%)} = \frac{W_2}{W_1} \times 100 \quad [3]$$

where $W_1$ is the input (kg) of the original bulk fibers and $W_2$ is the weight (kg) of the resulting blended yarn. Higher values of spinning yield indicate that the resulting blended yarn or doubled-and-twisted yarn exhibits good properties when passing through the process.

Tensile Strength and Retention of Strength on Ignition

The resulting blended yarn was measured for tensile strength before heating ($S_0$) and after heating in air at 400° C. for 30 minutes ($S_1$), respectively, in accordance with JIS R 3450, and the retention of strength on ignition was determined by the expression [2] as a percentage.

Ignition loss when heated in air at 850° C. for 30 minutes

The resulting blended yarn was measured for ignition loss when heated in air at 850° C. for 30 minutes in accordance with JIS R 3450.

Flexibility

The flexibility was measured by the cantilever method and expressed by the symbols:

○: excellent flexibility

Δ: poor flexibility

X: very poor flexibility

Resistance to flexing abrasion of cloths

The resistance to flexing abrasion was measured by a 180° repeated flexing test machine. The resistance to flexing abrasion of cloths was expressed by the symbols:

○: very excellent

Δ: poor

X: very poor

Example 1

Stainless steel (SUS) fibers having a fiber diameter of 8 μm were cut into slivers having an average length of 50 mm by a cutting machine. The stainless steel fibers had a tensile strength of 135 kgf/mm$^2$. The slivers of the stainless steel fibers and polybenzoxazole (PBO) fibers having an average fiber diameter of 12 μm (or 1.5 deniers per single filament) and an average fiber length of 44 mm (the PBO fibers exhibited an ignition loss of 20% when heated in air at 500° C. for 60 minutes and of 62.6% when heated in air at 800° C. for 30 minutes) were uniformly dispersed in amounts of 20% and 80% by weight, respectively, with an opening machine, and a blended yarn having a diameter of 0.4 mm and about 5 twists per inch as a number of twist was produced by the known method. Then, four such blended yarns were provided with 5 twists per inch in opposite direction to give a doubled-and-twisted yarn.

The doubled-and-twisted yarn was then woven into four combined layers by a weaving machine to give a cloth having a thickness of 8 mm and a width of 100 mm. The cloth was fed to a 180° repeated flexing test machine and the flexing test was repeated 50 times. Neither rupture nor fracture was caused in the cloth.

The results of evaluation for the resulting blended yarn and cloth are shown in Tables 1 and 2.

Example 2

A blended yarn having a diameter of 0.4 mm and about 5 twists per inch as a number of twist was produced in the same manner as described in Example 1, except that polybenzoxazole (PBO) fibers having an average fiber diameter of 12 μm (or 1.5 deniers per single filament) and an average fiber length of 44 mm (the PBO fibers exhibited an ignition loss of 20% when heated in air at 500° C. for 60 minutes and of 62.6% when heated in air at 800° C. for 30 minutes) and alumina-silica (AS) ceramic bulk fibers having an average fiber diameter of 3 μm (the AS fibers had a tensile strength of 80 kgf/mm$^2$) were used in amounts of 70% and 30% by weight, respectively. Then, a doubled-and-twisted yarn was produced in the same manner as described in Example 1.

The doubled-and-twisted yarn was then woven in three combined layers by a weaving machine to give a cloth having a thickness of 6 mm and a width of 100 mm. For such a cloth, the flexing test was repeated 50 times. Neither rupture nor fracture was caused in the cloth.

The results of evaluation for the resulting blended yarn and cloth are shown in Tables 1 and 2.

Example 3

A blended yarn having a diameter of 0.4 mm and about 5 twists per inch as a number of twist was produced in the same manner as described in Example 1, except that polybenzoxazole (PBO) fibers having an average fiber diameter of 12 μm (or 1.5 deniers per single filament) and an average fiber length of 44 mm (the PBO fibers exhibited an ignition loss of 20% when heated in air at 500° C. for 60 minutes and of 62.6% when heated in air at 800° C. for 30 minutes), alumina-silica (AS) bulk fibers having an average fiber diameter of 3 μm (the AS fibers had a tensile strength of 80 kgf/mm$^2$), and slivers of stainless steel (SUS) fibers having a fiber diameter of 8 μm and an average length of 50 mm (the SUS fibers had a tensile strength of 135 kgf/mm$^2$), which had been obtained by a cutting machine, were used in amounts of 60%, 20% and 20% by weight, respectively. Then, a doubled-and-twisted yarn was produced in the same manner as described in Example 1.

The doubled-and-twisted yarn was used to produce a cloth in the same manner as described in Example 2. For such a cloth, the flexing test was repeated 50 times. Neither rupture nor fracture was caused in the cloth.

The results of evaluation for the resulting blended yarn and cloth are shown in Tables 1 and 2.

Example 4

A blended yarn and a cloth were produced in the same manner as described in Example 1, except that the mixing ratio of polybenzoxazole fibers to stainless steel fibers was changed.

Comparative Example 1

A blended yarn having a diameter of 0.4 mm and about 5 twists per inch as a number of twist was produced in the same manner as described in Example 1, except that the stainless steel (SUS) fibers as described in Example 1 and the ceramic (AS) fibers as described in Example 2 were used in amounts of 40% and 60% by weight, respectively. Then, a doubled-and-twisted yarn was produced in the same manner as described in Example 1.

The doubled-and-twisted yarn was then used to produce a cloth in the same manner as described in Example 1.

The results of evaluation for the resulting blended yarn and cloth are shown in Tables 1 and 2.

Comparative Example 2

A doubled-and-twisted yarn was produced from blended yarns and a cloth was then obtained in the same manner as described in Example 1, except that para-aramid (PA) fibers having 1.5 deniers per single filament (the PA fibers exhibited an ignition loss of 98% when heated in air at 500° C. for 60 minutes and of 98.4% when heated in air at 800° C. for 30 minutes) were used in place of the polybenzoxazole fibers.

The results of evaluation for the resulting blended yarn and cloth are shown in Tables 1 and 2.

Comparative Example 3

A doubled-and-twisted yarn was produced and a cloth was then obtained in the same manner as described in Example 1, except that asbestos was used in an amount of 100% by weight. The results of evaluation for the resulting doubled-and-twisted yarn and cloth are shown in Tables 1 and 2.

Comparative Example 4

A doubled-and-twisted yarn was produced and a cloth was then obtained in the same manner as described in Example 1, except that stainless steel (SUS) fibers were used in an amount of 100% by weight. The results of evaluation for the resulting doubled-and-twisted yarn and cloth are shown in Tables 1 and 2.

TABLE 2

| | Ignition loss of blended yarn when heated in air at 850° C. for 30 minutes (%) | Flexibility of cloths | Resistance to flexing abrasion of cloths |
|---|---|---|---|
| Example 1 | 45 | ○ | ○ |
| Example 2 | 40 | ○ | ○ |
| Example 3 | 35 | ○ | ○ |
| Example 4 | −1*2 | ○ | ○ |
| Comp. Ex. 1 | 5 | x | x |
| Comp. Ex. 2 | 73 | ○ | ○ |
| Comp. Ex. 3 | 14*1 | Δ | ○ |
| Comp. Ex. 4 | −3*1,*2 | x | Δ |

*1: The measurements were carried out in the same manner for the doubled-and-twisted yarns produced in place of the blended yarns.
*2: The weights of the sample pieces were increased after heating by oxidation of stainless steal.

As can be seen from Table 1, the blended yarns obtained in Examples 1 to 4 exhibited high values for retention of strength on ignition. This means that the blended yarns obtained in Examples 1 to 4 had excellent heat resistance. Furthermore, as can be seen from Table 2, the cloths obtained in Examples 1 to 4 had excellent flexibility and excellent resistance to flexing abrasion.

According to the present invention, there are provided blended fibers having improved heat resistance, strength, resistance to flexing abrasion, light-weight properties, cut resistance and flexibility, which can be used in place of asbestos. In the present invention, the spinning treatment of inorganic fibers such as ceramic fibers, which have excellent heat resistance but are difficult to give non-blended yarns by spinning, can be extremely facilitated by blending with heat resistant organic fibers. In the case of metal fibers having high specific gravity, such as stainless steel fibers, high temperature resistant blended yarns having excellent light-weight properties can be produced by blending with heat resistant organic fibers having low specific gravity. Further provided are blended yarns extremely preferred from an environmental point of view because they have excellent heat resistant and excellent flame retardant properties without using asbestos which have adverse effects on the human bodies.

What is claimed is:

1. A high temperature resistant blended yarn exhibiting an ignition loss of 70% or less when heated in air at 850° C. for 30 minutes.

TABLE 1

| | Sample*1 | Weight ratio (%) | Diameter of doubled-and-twisted yarn (mm) | Moisture content (%) | Spinning yield (%) | Tensile strength before heating ($S_0$) (kgf/g) | Tensile strength after heating in air at 400° C. for 30 minutes ($S_1$) (kgf/g) | Retention of strength on ignition (%) |
|---|---|---|---|---|---|---|---|---|
| Example 1 | PBO/SUS | 80/20 | 0.4 × 4 yarns | 1.3 | 97 | 21 | 17 | 81 |
| Example 2 | PBO/AS | 70/30 | 0.4 × 4 yarns | 1.3 | 85 | 13 | 10 | 77 |
| Example 3 | PBO/SUS/AS | 60/20/20 | 0.4 × 4 yarns | 1.0 | 89 | 15 | 12 | 80 |
| Example 4 | PBO/SUS | 20/80 | 0.4 × 4 yarns | 0.3 | 80 | 13 | 11 | 84 |
| Comp. Ex. 1 | SUS/AS | 40/60 | 0.4 × 4 yarns | 1.5 | 71 | 10 | 10 | 100 |
| Comp. Ex. 2 | PA/SUS | 80/20 | 0.4 × 4 yarns | 3.8 | 96 | 18 | 4 | 22 |
| Comp. Ex. 3 | asbestos | _*2 | 0.4 × 4 yarns | 3.0 | 65 | 4 | 4 | 100 |
| Comp. Ex. 4 | SUS | _*2 | 0.4 × 4 yarns | 0.1 | 73 | 12 | 10 | 83 |

*1: PBO, polybenzoxazole fibers; SUS, stainless steel fibers; AS, alumina-silica ceramic bulk fibers; PA, para-aramid fibers.
*2: In these experiments, non-blended yarns were produced with the materials indicated.

2. A blended yarn according to claim 1, exhibiting an ignition loss of 60% or less when heated in air at 850° C. for 30 minutes.

3. A blended yarn according to claim 1, comprising a polybenzazole fiber in an amount of from 1% to 99% by weight.

4. A blended yarn according to claim 1, having a tensile strength of at least 0.1 kgf/g after heating in air at 400° C. for 30 minutes.

5. A blended yarn according to claim 1, exhibiting at least 50% retention of strength on ignition.

6. A high temperature resistant blended yarn comprising a heat resistant organic fiber and at least one selected from the group consisting of inorganic fibers and metal fibers, wherein the heat resistant organic fiber exhibits an ignition loss of 70% or less when heated in air at 500° C. for 60 minutes.

7. A blended yarn according to claim 6, wherein the heat resistant organic fiber exhibits an ignition loss of 60% or less when heated in air at 500° C. for 60 minutes.

8. A blended yarn according claim 6, wherein the heat resistant organic fiber is a polybenzazole fiber contained in an amount of from 1% to 99% by weight.

9. A high temperature resistant blended yarn comprising a heat resistant organic fiber and at least one fiber selected from the group consisting of inorganic fibers and metal fibers, wherein the heat resistant organic fiber exhibits an ignition loss of 85% or less when heated in air at 800° C. for 30 minutes.

10. A blended yarn according to claim 6, wherein the heat resistant organic fiber exhibits an ignition loss of 30% or less when heated in air at 800° C. for 30 minutes.

11. A blended yarn according to claim 9, wherein said heat resistant organic fiber is a polybenzazole fiber.

12. A blended yarn according to claim 10, wherein said heat resistant organic fiber is a polybenzazole fiber.

* * * * *